US005565306A

United States Patent [19]

Meguro et al.

[11] Patent Number: 5,565,306

[45] Date of Patent: Oct. 15, 1996

[54] THERMOFIXABLE PHOTOSENSITIVE RECORDING MATERIAL AND PROCESS FOR PREPARING THEREOF

[75] Inventors: Tatsuya Meguro, Nishinomiya; Nobuhisa Danou, Osaka; Tetsuo Tsuchida, Takarazuka; Naoto Arai, Ikeda, all of Japan

[73] Assignee: New OJI Paper Co., Ltd., Tokyo, Japan

[21] Appl. No.: 380,572

[22] Filed: Jan. 30, 1995

(Under 37 CFR 1.47)

[30] Foreign Application Priority Data

Jan. 28, 1994 [JP] Japan ..... 6-008829

[51] Int. Cl.[6] ..... G03C 1/73; B41M 5/30

[52] U.S. Cl. ..... 430/341; 430/337; 430/340; 430/352; 430/343; 430/338

[58] Field of Search ..... 430/337, 340, 430/341, 352, 343, 338

[56] References Cited

U.S. PATENT DOCUMENTS 3,390,995 7/1968 Manos ..... 430/340

3,902,903 9/1975 Itano et al. ..... 430/351

4,379,835 4/1983 Lowrey et al. ..... 430/341

5,372,917 12/1994 Tsuchida et al. ..... 430/343

*Primary Examiner*—Mark F. Huff

*Attorney, Agent, or Firm*—Nikaido, Marmelstein, Murray & Oram LLP

[57] ABSTRACT

The present invention provides a thermofixable photosensitive recording material comprising a substrate and a recording layer formed thereon in which a pyrazolone derivative represented by the formula (1 ) shown in the specification and functions as a color former, and a hydroquinone derivative and an acidic substance which function as a color forming auxiliary agent or fixing auxiliary agent are dissolved mutually therein.

Further, a binder can be added as required to the recording layer, thereby four components are dissolved mutually therein.

15 Claims, No Drawings

THERMOFIXABLE PHOTOSENSITIVE RECORDING MATERIAL AND PROCESS FOR PREPARING THEREOF

The present invention relates to a thermofixable photosensitive recording material which forms a color directly by ultraviolet rays irradiation, and can be easily fixed by heating.

Various photosensitive recording materials which form a color directly by light irradiation have been proposed. Most of them utilize a color forming due to a chemical reaction between a color former and a photoactivator. For example, those which are recorded by ultraviolet rays irradiation, using a dye precursor or a dye constituent element as the color former and using a polyhaloalkane compound as the photoactivator are well known as free-radical photographs. Regarding these photographs, the photoactivator is decomposed by ultraviolet rays irradiation and a dye image is formed by a free radical or acid which generate at the time of the above decomposition. When they are put into practical use, a toxicity of this photoactivator becomes a significant sanitary problem. Further, the photosensitive recording material using the photoactivator as described above is liable to be affected easily in heat or moisture, which results in poor stability with time. As a method for fixing an image in these photosensitive materials, for example, there can be used a method of volatilizing a photoactivator by heating, method of eluting a photoactivator by a solvent, method of reacting a photoactivator with a fixing agent, which coexists with the photoactivator, by heating and the like. However, these methods are not satisfactory enough for practical use because of their complicated operation, low fixing efficiency, problems on safety and sanitation, etc.

An object of the present invention is to provide a thermofixable photosensitive recording material containing no injurious substance, thus causing no sanitary problem, and which forms a color directly by ultraviolet rays irradiation and is easily fixed by heat, and also superior in long-term storage stability in dark place.

Another object of the present invention is to provide a process for preparing the thermofixable photosensitive recording material.

The above and other objects of the invention will become apparent from the following description.

The present invention provides a thermofixable photosensitive recording material comprising a substrate and a recording layer formed thereon in which a pyrazolone derivative represented by the formula (1) and functions as a color former, and a hydroquinone derivative and an acidic substance which function as a color forming auxiliary agent or fixing auxiliary agent are dissolved mutually therein (1)

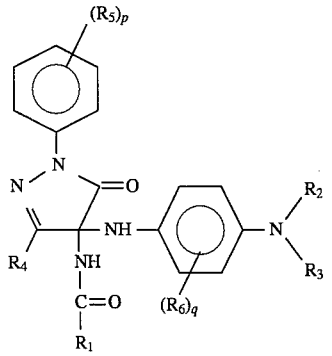

wherein, in the formula (1), $R_1$ is alkyl, alkoxyalkyl, aryl or aryl having a substituent, $R_2$ and $R_3$ are each alkyl, alkyl having a substituent, aryl or aryl having a substituent, $R_4$ is alkyl, alkyl having a substituent, aryl, aryl having a substituent, amino or amino having a substituent, $R_5$ and $R_6$ are each alkyl, alkoxyl or a halogen atom, p is 0 or an integer of 1 to 5, and q is 0 or an integer of 1 to 4.

Further, a binder can be added as required to the recording layer, thereby four components are dissolved mutually therein.

The present inventors have studied intensively about a thermofixable photosensitive recording material containing no injurious substance such as polyhaloalkane compound, which forms a color directly by light irradiation and can be fixed by heating. As a result, it has been found that the above thermofixable photosensitive recording material comprising the above three components as essential components forms a color in high sensitivity to light and can be easily fixed by heating, thus the present invention has been completed.

The thermofixable photosensitive recording material of the present invention can be obtained by dissolving the specific pyrazolone derivative, a hydroquinone derivative, an acidic substance and, as required, a binder in an organic solvent, or dissolving the above three essential components in an electron rays-curable prepolymer and/or monomer which functions as a solvent and a binder, applying the resulting coating composition for the recording layer on a substrate, and drying or irradiating an electron rays to cure the recording layer. Further, it is possible to emulsifying the above solution of the organic solvent or of the electron rays-curable prepolymer and/or monomer in water to obtain a coating composition for recording layer.

The above specific pyrazolone derivative used as the color former in %he present invention is a substantially colorless and nonvolatile stable compound, and it hardly exhibits a color forming property by ultraviolet rays irradiation. However, when ultraviolet rays are irradiated to a mixture in amorphous state wherein three components, namely this specific pyrazolone derivative, a hydroquinone derivative and an acidic substance as the color forming auxiliary agent are dissolved mutually therein, a color forming reaction of the pyrazolone derivative is arisen, although its mechanism is not known definitely, thereby forming an azomethine dye. Accordingly, color forming due to ultraviolet rays irradiation, i.e. formation of an image is based on the formation of this azomethine dye. Since the azomethine dye is a stable dye which does not become colorless under a normal condition if once it has been formed, the dye image can be preserved for a long period of time.

Although the color tone of the thermofixable photosensitive recording material of the present invention varies depending upon a kind of the respective essential components, kind of the binder, etc. or formulation ratio thereof, it assumes reddish purple to bluish purple.

On the other hand, a specific pyrazolone derivative itself has a feature that it rather forms a dye in low sensitivity by heating. However, when the hydroquinone derivative and the acidic substance as the fixing auxiliary agent of the present invention further coexist with the above pyrazolone derivative, the pyrazolone derivative causes no color forming reaction by heating and becomes inert to ultraviolet rays. Accordingly, the fixing of the present thermofixable photosensitive recording material is completed when heated after forming recorded images with the irradiation of ultraviolet rays. Although the mechanism of the above three components at the heat-fixing is not known definitely, it is considered that the pyrazolone derivative is converted to colorless inert molecular species by influence of coexisting the hydroquinone derivative and the acidic substance.

In the pyrazolone derivative represented by the above formula (1), $R_1$ is alkyl, alkoxyalkyl, aryl or aryl having a substituent. The aryl is phenyl, naphthyl or an aromatic heterocyclic residue. Examples of substituents are alkyl, alkoxyl, halogen atoms, and equivalents. Preferable as $R_1$ among these are $C_1$~$C_4$ alkyl and phenyl, and particularly preferable is $C_1$~$C_4$ alkyl from a viewpoint of easiness of preparation.

$R_2$ and $R_3$ are each alkyl, alkyl having a substituent, aryl or aryl having a substituent. Examples of substituents for alkyl are aryl, alkoxyl, hydroxyl, alkylsulfonylamino, and equivalents. Examples of substituents for aryl are alkyl, alkoxyl, halogen atoms, and equivalents. Preferable as $R_2$ and $R_3$ among these are $C_1$~$C_4$ alkyl groups which may have $C_1$~$C_4$ alkoxyl, hydroxyl or $C_1$~$C_4$ alkylsulfonylamino as a substituent from a viewpoint of easiness of preparation.

$R_4$ is alkyl, alkyl having a substituent, aryl, aryl having a substituent, amino or amino having a substituent. Examples of substituents for alkyl are aryl, alkoxyl, aryloxy, acylamino, N-substituted carbamoyl, N-substituted sulfamoyl, and equivalents. Examples of substituents for aryl are alkyl, alkoxyl, aryloxy, halogen atoms, arylalkyl, arylalkoxyl, aryloxyalkoxyl, arylsulfonylalkoxyl, acylamino, alkylsulfonylamino, arylsulfonylamino, N-substituted carbamoyl, N-substituted sulfamoyl, and equivalents. Examples of substituents for amino are alkyl, aryl, alkylcarbonyl, arylcarbonyl, alkylsulfonyl, arylsulfonyl, and equivalents. The alkyl groups and aryl groups as substituents may further have a substituent. Examples of substituents for the alkyl groups are aryl, alkoxyl, aryloxy, acylamino, N-substituted carbamoyl, N-substituted sulfamoyl, and equivalents. Examples of substituents for the aryl groups are alkyl, alkoxyl, aryloxy, halogen atoms, arylalkyl, arylalkoxyl, aryloxyalkoxyl, arylsulfonylalkoxyl, imido, acylamino, alkylsulfonylamino, arylsulfonylamino, N-substituted carbamoyl, N-substituted sulfamoyl, and equivalents.

The thermofixable photosensitive recording materials using a pyrazolone derivative which contains an aroylamino or aryl group, each of which may have a substituent, for $R_4$ is superior in light color forming and thermal fixing properties, and is preferable so as to make a period of time of recording and fixing processes short. Among them, those which have an aryl group, which may have a substituent, are preferable, and those which have a phenyl or naphthyl group, each of which may have $C_1$~$C_4$ alkyl, $C_1$~$C_4$ alkoxyl or halogen atom as a substituent, are particularly preferable.

The followings are examples of the pyrazolone derivatives. 1-Phenyl-3-methyl-4-(4-N,N-dimethylaminophenylamino)-4-acetylamino-5-pyrazolone, 1-phenyl-3-methyl-4-(4-N,N-diethylaminophenylamino)-4-acetylamino-5-pyrazolone, 1-Phenyl-3-methyl-4-(4-N,N-diethylamino-2-methylphenylamino)-4-acetylamino-5-pyrazolone, 1-phenyl-3-methyl-4-(4-N,N-diethylaminophenylamino)-4-benzoylamino-5-pyrazolone, 1-phenyl-3-tert-butyl-4-(4-N,N-diethylaminophenylamino)-4-acetylamino-5-pyrazolone, 1-phenyl-3-dodecyl-4-(4-N,N-diethylaminophenylamino)-4-acetylamino-5-pyrazolone, 1-(2,4,6-trichlorophenyl)-3-methyl-4-(4-N,N-diethylaminophenylamino)-4-acetylamino-5-pyrazolone, 1,3-diphenyl-4-(4-N,N-dimethylaminophenylamino)-4-acetylamino-5-pyrazolone, 1,3-diphenyl-4-(4-N,N-diethylaminophenylamino)-4-acetylamino-5-pyrazolone, 1,3-diphenyl-4-(4-N,N-dibutylaminophenylamino)-4-acetylamino-5pyrazolone, 1,3-diphenyl-4-(4-N,N-diethylamino-2-methylphenyl-amino)-4-acetylamino-5-pyrazolone, 1,3-diphenyl-4-(4-N,N-diethylamino- 2-methoxyphenylamino)-4-acetylamino-5-pyrazolone, 1,3-diphenyl-4-(4-N,N-diethylamino-2-ethoxyphenylamino)-4-acetylamino-5-pyrazolone, 1,3-diphenyl-4-[4-N-ethyl-N-(2hydroxyethyl)aminophenylamino]4-acetylamino-5-pyrazolone, 1,3-diphenyl-4-[4-N-ethyl-N-(2-methylsulfonylaminoethyl)-aminophenylamino]-4-acetylamino-5-pyrazolone, 1,3-diphenyl-4-[4-N-ethyl-N-(2-methoxyethyl)aminophenylamino]-4-acetylamino5-pyrazolone, 1,3-diphenyl-4-(4-N,N-diethylaminophenylamino)4-benzoylamino-5-pyrazolone, 1,3-diphenyl-4-(4-N,N-diethylaminophenylamino)-4-p-toluoylamino-5-pyrazolone, 1-phenyl-3-p-tolyl-4-(4-N,N-diethylaminophenylamino)-4-acetylamino-5-pyrazolone, 1-phenyl-3-p-tolyl-4-(4-N,N-diethylamino-2-methylphenylamino)-4-acetylamino-5-pyrazolone, 1-phenyl-3-p-methoxyphenyl-4-(4-N,N-diethylaminophenylamino)4-acetylamino-5-pyrazolone, 1-phenyl-3-(2,4-xylyl)-4-(4-N,N-diethylaminophenylamino)-4-acetylamino-5-pyrazolone, 1-Phenyl-3-p-cumenyl-4-(4-N,N-diethylaminophenylamino)-4-acetylamino-5pyrazolone, 1-phenyl-3-o-tolyl-4-(4-N,N-diethylaminophenyl-amino)-4-acetylamino-5-pyrazolone, 1-phenyl-3-p-chlorophenyl-4-(4-N,N-diethylaminophenylamino)-4-acetylamino-5-pyrazolone, 1-p-tolyl-3-phenyl-4-(4-N,N-diethylaminophenylamino)-4-acetylamino-5-pyrazolone, 1-mesityl-3-phenyl-4-(4-N,N-diethylaminophenylamino)-4-acetylamino-5-pyrazolone, 1-p-methoxyphenyl-3-phenyl-4-(4-N,N-diethylaminophenylamino)-4-acetylamino-5-pyrazolone, 1-(2,4,6-trichlorophenyl)-3-phenyl-4-(4-N,N-diethylaminophenylamino)-4-acetylamino-5-pyrazolone, 1-phenyl-3-[3-(2,4-di-tert-pentylphenoxyacetylamino)phenyl]-4(4-N,N-diethylaminophenylamino)-4-acetylamino-5-pyrazolone, 1-phenyl-3-[3-(phenylsulfonylamino) phenyl]-4-(4-N,N-diethylaminophenylamino)-4-acetylamino-5-pyrazolone, 1-phenyl-3-(1-naphthyl)-4-(4-N,N-dimethylaminophenylamino)-4-acetylamino-5-pyrazolone, 1-phenyl-3-(2-naphthyl)-4-(4-N,N-diethylaminophenylamino)-4-acetylamino-5-pyrazolone, 1-phenyl-3-(1-naphthyl)-4-(4-N,N-diethylaminophenylamino)-4-acetylamino-5-pyrazolone, 1-phenyl-3-(1-naphthyl)-4-(4-N,N-dibutylaminophenylamino)-4-acetylamino-5-pyrazolone, 1-phenyl-3-(1-naphthyl)-4-(4-N,N-diethylamino-2-methylphenylamino)-4-acetylamino-5-pyrazolone, 1-phenyl-3-(1-naphthyl)-4-(4-N,N-diethylamino-2-methoxyphenylamino)-4-acetylamino-5-pyrazolone, 1-phenyl-3-(1-naphthyl)-4-(4-N,N-diethylamino-2-methoxyphenylamino)-4-acetylamino-5-pyrazolone, 1-phenyl-3-(1-naphthyl)-4-[4-N-ethyl-N-(2-hydroxyethyl)aminophenylamino]-4-acetylamino-5-pyrazolone, 1-phenyl-3-(1-naphthyl)-4-[4-N-ethyl-N-(2-methylsulfonylaminoethyl)aminophenylamino]-4-acetylamino-5-pyrazolone, 1-phenyl-3-(1-naphthyl)-4-[4-N-ethyl-N-(2-methoxyethyl)aminophenylamino]-4-acetylamino-5pyrazolone, 1-phenyl-3-(1-naphthyl)-4-(4-N,N-diethylamino-phenylamino)-4-benzoylamino-5-pyrazolone, 1-phenyl-3-(1-naphthyl)-4-(4-N,N-diethylaminophenylamino)-4-p-toluoylamino-5-pyrazolone, 1-phenyl-3-(2-naphthyl)-4-(4-N,N-diethylaminophenylamino)-4-acetylamino-5-pyrazolone, 1-phenyl-3-(4-methyl-1-naphthyl)-4-(4-N,N-diethylaminophenylamino)-4-acetylamino-5-pyrazolone, 1-phenyl-3-(4-methoxy-1-naphthyl)-4-(4-N,N-diethylaminophenylamino)-4-acetylamino-5-pyrazolone, 1-phenyl-3-(2,4-dimethyl-1-naphthyl)-4-(4-N,N-diethylaminophenylamino)-4-acetylamino-5-pyrazolone, 1-phenyl-3-(4-isopropyl-1-naphthyl)- 4-(4-N,N-diethylaminophenylamino)-4-acetylamino-5-pyrazolone, 1-p-tolyl-3-(1-naphthyl)-4-(4-N,N-diethylamino-phenylamino)-4-acetylamino-5-pyrazolone, 1-mesityl-3-(1-naphthyl)-4-(4-

N,N-diethylaminophenylamino)-4-acetylamino-5pyrazolone, 1-p-methoxyphenyl-3-(1-naphthyl)-4-(4-N,N-diethylaminophenylamino)-4-acetylamino-5-pyrazolone, 1-(2,4,6-trichlorophenyl)-3-(1-naphthyl)-4-(4-N,N-diethylaminophenylamino)-4-acetylamino-5-pyrazolone, 1-phenyl-3-benzyl-4-(4-N,N-dimethylaminophenylamino)-4-acetylamino-5-pyrazolone, 1-phenyl-3-benzyl-4-(4-N,N-diethylaminophenylamino)-4-acetylamino-5-pyrazolone, 1-phenyl-3-benzyl-4-(4-N,N-diethylamino-2-methylphenylamino)-4-acetylamino-5-pyrazolone, 1-phenyl-3-benzyl-4-(4-N,N-diethylaminophenylamino)-4-benzoylamino-5-pyrazolone, 1-phenyl-3-phenethyl-4-(4-N,N-diethylaminophenylamino)-4-acetylamino-5-pyrazolone, 1-phenyl-3-(1-naphthylmethyl)-4-(4-N,N-diethylaminophenylamino)-4-acetylamino-5-pyrazolone, 1-phenyl-3-(2-naphthylmethyl)-4-(4-N,N-diethylaminophenylamino)-4-acetylamino-5-pyrazolone, 1-phenyl-3-α-methylbenzyl-4-(4-N,N-diethylaminophenylamino)-4-acetylamino-5-pyrazolone, 1-phenyl-3-benzhydryl-4-(4-N,N-diethylaminophenylamino)-4-acetylamino-5-pyrazolone, 1-(2,4,6-trichlorophenyl)-3-benzyl-4-(4-N,N-diethylaminophenylamino)-4-acetylamino-5-pyrazolone, 1-phenyl-3-anilino-4-(4-N,N-diethylaminophenylamino)-4-acetylamino-5-pyrazolone, 1-phenyl-3-(2-chloroanilino)-4-(4-N,N-diethylaminophenylamino)-4-acetylamino-5-pyrazolone, 1-phenyl-3-(4-methoxyanilino)-4-(4-N,N-diethylaminophenylamino)-4-acetylamino-5-pyrazolone, 1-phenyl-3-p-toluidino-4-(4-N,N-diethylaminophenylamino)-4-acetylamino-5-pyrazolone, 1-(2,4,6-trichlorophenyl)-3-[2-chloro-5-(3-octadecylsuccinylimino)anilino]-4-(4-N,N-diethylaminophenylamino)-4-acetylamino-5-pyrazolone, 1-phenyl-3-benzoylamino-4-(4-N,N-diethylaminophenylamino)-4-acetylamino-5-pyrazolone, 1-phenyl-3-benzoylamino-4-(4-N,N-dibutylaminophenylamino)-4-acetylamino-5-pyrazolone, 1-phenyl-3-benzoylamino-4-(4-N,N-diethylamino-2-ethylphenylamino)-4-acetylamino-5-pyrazolone, 1-phenyl-3-benzoylamino-4-[4-N-ethyl-N-(2-hydroxyethyl)aminophenylamino]-4-acetylamino-5pyrazolone, 1-phenyl-3-p-toluoylamino-4-(4-N,N-diethylamino-phenylamino)-4-acetylamino-5-pyrazolone, 1-phenyl-3-p-chlorobenzoylamino-4-(4-N,N-diethylaminophenylamino)-4-acetylamino-5-pyrazolone, 1-phenyl-3-[3-(2,4-di-tert-pentylphenoxyacetylamino)benzoylamino]-4-(4-N,N-diethylaminophenylamino)-4-acetylamino-5-pyrazolone, 1-(2,4,6-trichlorophenyl)-3-{3-[2-(2,4-di-tert-pentylphenoxy)hexanoylamino]benzoylamino}-4-(4-N,N-diethylaminophenylamino)-4-acetylamino-5-pyrazolone, 1-(2,4,6-trichlorophenyl)-3-[3(2,4-di-tert-pentylphenoxyacetylamino)benzoylamino]-4-(4-N,N-diethylaminophenylamino)-4-acetylamino-5-pyrazolone, 1-phenyl-3-phenylacetylamino-4-(4-N,N-diethylaminophenylamino)-4-acetylamino-5-pyrazolone, 1-phenyl-3-pivaloylamino-4-(4-N,N-diethylaminophenylamino)-4-acetylamino-5-pyrazolone, 1-phenyl-3-stearoylamino-4-(4-N,N-diethylaminophenylamino)-4-acetylamino-5-pyrazolone, 1,3-diphenyl-4-(4-N,N-diethylaminophenylamino)-4-propionylamino-5-pyrazolone, and equivalents. Of course, the pyrazolone derivative is not limited to thereabove and as required at least two of them are used.

Although the proportion of the specific pyrazolone derivative to be used in the present invention is not specifically limited and varies depending on the molecular extinction coefficient of the pyrazolone derivative at the time of color forming, it is generally preferable to use in a range of 1 to 20% by weight, preferably 5 to 10% by weight, based on the total solid weight of the thermofixable photosensitive recording layer.

In the present invention, the hydroquinone derivative to be used as the color forming or fixing auxiliary agent along with the acidic substance means hydroquinone containing at least one alkyl group, cycloalkyl group, aralkyl group, aryl group, aryloxycarbonyl group, alkoxycarbonyl group, aryloxysulfonyl group, alkoxysulfonyl group, arylsulfonyl group, alkylsulfonyl group, arylcarbonyl group, alkylcarbonyl group or halogen atom in the aromatic nucleus. Among them, the thermofixable photosensitive recording material using the compound of the formula (2) is preferable because it is superior in light color forming and thermal fixing properties to the other one

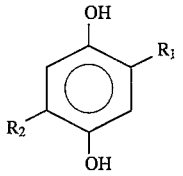

(2)

wherein, in the formula (2), $R_1$ is $C_1$~$C_{22}$ alkyl, $C_5$~$C_6$ cycloalkyl or $C_7$~$C_{22}$ aralkyl, $R_2$ is hydrogen atom, $C_1$~$C_{22}$ alkyl, $C_5$~$C_6$ cycloalkyl or $C_7$~$C_{22}$ aralkyl.

These compounds are substantially colorless and non-volatile stable compounds and known as an antioxidant for rubber and plastic, which are easily available. Among the hydroquinone derivative of the formula (2), the thermofixable photosensitive recording material using those in which $R_1$ is $C_1$ ~$C_8$ alkyl, $C_5$~$C_6$ cycloalkyl or $C_7$~$C_{10}$ aralkyl, $R_2$ is a hydrogen atom, $C_1$~$C_8$ alkyl, $C_5$~$C_6$ cycloalkyl or $C_7$~$C_{10}$ aralkyl is preferable. The thermofixable photosensitive recording material using those in which $R_2$ is a hydrogen atom is most preferable because it is superior in light color forming and thermal fixing properties to the other one. Examples of the hydroquinone derivative are as follows. 2-tert-octylhydroquinone, 2-tert-pentylhydroquinone, 2-tert-butylhydroquinone, 2-sec-butylhydroquinone, 2-isopropylhydroquinone, 2-methylhydroquinone, 2-(1,3,5-trimethylhexyl)hydroquinone, 2-α-methylbenzylhydroquinone, 2-α,α-dimethylbenzylhydroquinone, 2-cyclohexylhydroquinone, 2,5-di-tert-pentylhydroquinone, 2,5-di-tert-butylhydroquinone, 2,5-di-sec-butylhydroquinone, 2,5-diisopropylhydroquinone, 2,5-dimethylhydroquinone, 2,5-bis(1,3,5-trimethylhexyl)hydroquinone, 2,5-bis(α-methylbenzyl)hydroquinone, 2,5bis(α,α-dimethylbenzyl)hydroquinone, 2,5-dicyclohexylhydroquinone, 2-tert-butyl-5-methylhydroquinone, 2-tert-butyl-5-cyclohexylhydroquinone, 2-tert-butyl-5-phenylhydroquinone, 2-tert-butyl-5-α-methylbenzylhydroquinone, and equivalents.

Of course, the hydroquinone derivative is not limited to thereabove and as required at least two of them are used. Although the amount of the hydroquinone derivative to be used in the present invention is not limited specifically, it is generally desirable to use 50 to 700% by weight, more desirably 100 to 500% by weight, of the pyrazolone derivative.

In the present invention, the acidic substance to be used as the color forming auxiliary agent or fixing auxiliary agent along with the hydroquinone derivative means a substance serving as Brønsted acid or Lewis acid, and examples thereof include organic acidic substances such as aliphatic or aromatic carboxylic acid derivatives and phenol derivatives, polyvalent metal salts thereof, and metal complex such as complexes of zinc thiocyanate with organic base ligands. In the present invention, the acidic substance exhibits a synergic action with the hydroquinone derivative, as described above. In order to develop this synergic action, the respective essential components must be maintained in the amorphous state in the thermofixable photosensitive recording material of the present invention. Therefore, the acidic substance which has a sufficiently high compatibility with the other essential component is preferable. Further, since the thermofixable photosensitive recording material using the acidic substance having a comparatively high acidity is preferable because it is superior in light color forming and thermal fixing properties. Therefore, aromatic carboxylic acid derivatives or polyvalent metal salts thereof are preferable, and benzoic acid or salicylic acid or polyvalent metal salts thereof are particularly preferable. Examples of the acidic substance are as follows. 4,4'-isopropylidenediphenol, 4,4'-isopropylidene(2-chlorophenol), 4,4'-isopropylidenebis(2,6-dichlorophenol), 4,4'-isopropylidenebis(2,6-dibromophenol), 4,4'-isopropylidenebis(2-methylphenol), 4,4'-isopropylidenebis(2,6dimethylphenol), 4,4'-sec-butylidenediphenol, 2,2-bis(4-hydroxyphenyl)-4-methylpentane, 4,4'-cyclohexylidenebisphenol, 4,4'-cyclohexylidenebis(2-methylphenol), 4-tert-butylphenol, 4-phenylphenol, 4-hydroxydipheny ether, α-naphthol, β-naphthol, 2,2'-thiobis(4,6-dichlorophenol), 4-tert-octylcatechol, 2,2'-methylenebis(4-chlorophenol), 2,2'-dihydroxybiphenyl, methyl-bis(4-hydroxyphenyl)acetate, ethyl-bis(4-hydroxyphenyl)acetate, benzyl-bis(4-hydroxyphenyl)-acetate, 4,4'-(p-phenylenediisopropylidene)diphenol, 4,4'-(m-phenylenediisopropylidene)diphenol, 4-hydoxydiphenylsulfone, 4,4'-dihydroxydiphenylsulfone, 2,4'-dihydroxydiphenylsulfone, 4-hydroxy-4'-methyldiphenylsulfone, 4-hydroxy-4'-isopropoxy-diphenylsulfone, 4-hydroxy-3',4'-tetramethylenediphenylsulfone, 4-hydroxy-3',4'-trimethylenediphenylsulfone, 4,4'-dihydroxydiphenylsulfide, 3,3'-diallyl-4,4'-dihydroxydiphenylsulfone, 2-phenoxyethyl bis(4-hydroxyphenyl)acetate, p-hydroxy-N-(2-phenoxyethyl)benzenesulfonamide, dimethyl 4-hydroxyphthalate, 1,5-bis(4-hydroxyphenylthio)-3-oxapentane, 1,7-bis(4-hydroxyphenylthio)-3,5-dioxa-heptane, 1,8-bis(4-hydroxyphenylthio)-3,6-dioxa-octane, 2-(4-hydroxyphenylthio)-ethyl (4-hydroxyphenylthio)acetate, 4-acetylphenol, 4-tert-octylphenol, 4,4'-dihydroxydiphenylmethane, resorcinol, catechol, pyrrogallol, propyl gallate, octyl gallate, isoamyl gallate, stearyl gallate, 4,4'-(1,3-dimethylbutylidene)-bisphenol, 4-hydroxy-4'-methyldiphenylsulfone, 3,4-dihydroxy-4'-methyldiphenylsulfone, hydroquinone monobenzyl ether, 4-hydroxybenzophenone, 2,4-dihydroxybenzophenone, 2,4,4'-trihydroxybenzophenone, 2,2',4,4'-tetrahydroxybenzophenone, 4,4'-dihydroxybenzophenone, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, p-chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, p-phenylphenol-formalin resin, p-butylphenolacetylene resin, novolak type phenol resin, phenolic polymer and like phenolic compounds; oxalic acid, maleic acid, tartaric acid, citric acid, succinic acid, stearic acid and like aliphatic carboxylic acids; benzoic acid, 4-tert-butylbenzoic acid, 4-trifluoromethyl-benzoic acid, 4chlorobenzoic acid, 4-nitrobenzoic acid, 3-sec-butyl-4hydroxybenzoic acid, 3-cyclohexyl-4-hydroxybenzoic acid, 3,5-dimethyl-4-hydroxybenzoic acid, α-naphthoic acid, β-naphthoic acid, 2-hydroxy-1-benzyl-3-naphthoic acid, phthalic acid, isophthalic acid, terephthalic acid, monomethyl terephthalate, gallic acid, salicylic acid, 3-isopropylsalicylic acid, 3-phenylsalicylic acid, 3-cyclohexylsalicylic acid, 3,5-di-tert-butylsalicylic acid, 3-methyl-5benzylsalicylic acid, 4-pentyloxysalicylic acid, 3-phenyl-5-(α,α-dimethylbenzyl)salicylic acid, 3,5-di-(α-methylbenzyl)salicylic acid, 3-dodecylsalicylic acid, 3-nonylsalicylic acid, 3-benzylsalicylic acid, 3-(α-methylbenzyl)salicylic acid, 3-chloro-5-(α- methylbenzyl)salicylic acid, 3,5-di-(α,α-dimethylbenzyl)salicylic acid, 3-(α,α-dimethylbenzyl)-5-methylsalicylic acid, 4-(3-phenylsulfonyl-propoxy)salicylic acid, 4-(5-phenylsulfonyl-3-oxa-pentyloxy)salicylic acid, 4-(3-p-tolylsulfonylpropoxy)salicylic acid, 4-(5-p-tolylsulfonyl-3-oxa-pentyloxy)salicylic acid, 4-(3-p-methoxyphenylsulfonylpropoxy) salicylic acid, 4(3-p-chlorophenylsulfonylpropoxy)salicylic acid, 4-(2-phenoxyethoxy)salicylic acid, 4-(2-p-methoxyphenoxyethoxy)-salicylic acid, 4-(5-p-methoxyphenoxy-3-oxa-pentyloxy)salicylic acid, 4-(5-phenoxy-3-oxa-pentyloxy)salicylic acid, 5-[p-(2-phenoxyethoxy)cumyl] salicylic acid, 5-[p-(5-phenoxy-3-oxa-pentyloxy)cumyl] salicylic acid, 5-[p-(2-p-methoxyphenoxyethoxy)cumyl] salicylic acid, 5-[p-(4-p-tolylsulfonylpropoxy)cumyl] salicylic acid, 5-[p-(3-phenylsulfonylpropoxy)cumyl] salicylic acid, 5-[p-(3-p-methoxyphenylsulfonylpropoxy)cumyl]salicylic acid and like aromatic carboxylic acids; polyvalent metal salt of such phenolic compound, aliphatic carboxylic acid of aromatic carboxylic acid; metal complex such as antipyrine complex with zinc thiocyanate, and equivalents. Of course, the acidic substance is not limited to thereabove and as required at least two of them are used.

The polyvalent metal which forms a salt or complex with such an acidic substance is preferably a bivalent, trivalent or tetravalent metal, more preferably zinc, calcium, aluminum, magnesium, tin or iron. Although the amount of the acidic substance to be used in the present invention is not limited specifically, it is generally desirable to use 50% to 700% by weight, more desirably 100 to 500% by weight, of the pyrazolone derivative.

In the thermofixable photosensitive recording material of the present invention, if necessary, components such as binders, plasticizers, ultraviolet rays absorbers, and equivalents may be further added to the recording layer, in addition to the above three components. These components are also required to form an amorphous state with the above three components. Among these components, it is desirable to use the binder which is effective to enhance the film strength of the recording layer and prevent crack or separation of the recording layer. Examples of the binder are polymer compounds having film-forming ability and soluble in an organic solvent, prepolymer or monomer which is curable with electron rays, and equivalents.

Examples of the polymer compounds soluble in an organic solvent include vinyl polymers or copolymers such as polystyrene, polyvinyl acetate, polyvinyl butyral, polybutadiene, polyvinyl pyrrolidone, and equivalents; polymers or copolymers of acrylic acids, methacrylic acids or esters thereof; polyesters such as poly(ethylene glycol~isophthalic acid~terephthalic acid), poly(p-cyclohexanedicarboxylic acid~isophthalic acid~cyclohexylenebismethanol), poly(p-cyclohexanedicarboxylic acid~2,2,4,4-tetramethylcyclobutane-1,3-diol), and equivalents; celluloses such as hydroxypropyl cellulose, acetyl cellulose, nitrocellolose, ethyl cellulose, butyl cellulose, cellulose acetate butyrate, cellulose acetate, cellulose triacetate, cellulose butyrate, and equivalents. Further, a plurality of these binders can also be used in combination.

The prepolymer or monomer which is curable with electron rays may be one which has at least one ethylenically unsaturated bond in the molecule and is liquid at an ordinary temperature. Examples thereof are as follows.

Examples of useful prepolymers are (a) poly(meth)acrylate of aliphatic, alicyclic or aromatic polyhydric alcohol having 2 to 6 valencies, or polyalkylene glycol; (b) poly(meth)acrylate of polyhydric alcohol which is an adduct of alkylene oxide and aliphatic, alicyclic or aromatic polyhydric alcohol having 2 to 6 valencies; (c) poly(meth)acryloyloxyalkylphosphoric acid ester; (d) polyesterpoly(meth)acrylate; (e) epoxypoly(meth)acrylate; (f) polyurethanepoly(meth) acrylate; (g) polyamidepoly(meth)acrylate; (h) polysiloxanepoly(meth)acrylate; (i) low-molecular-weight vinyl or diene polymer having (meth-)acryloyloxy group in the side chain and/or terminal; (j) modified product of the oligoester(meth)acrylate of the above (a)~(i), and equivalents.

Examples of useful monomers are (a) carboxyl group-containing monomer, which is represented by ethylenic unsaturated mono or polycarboxylic acid or the like, and carboxylic acid base-containing monomer such as alkali metal salt, ammonium salt, amine salt of these carboxyl group-containing monomer and equivalents; (b) amido group-containing monomer, which is represented by ethylenic unsaturated (meth)acrylamide, alkyl-substituted (meth-)acrylamide and vinyl lactams such as N-vinylpyrrolidone and equivalents; (c) sulfonic acid group-containing monomer, which is represented by aliphatic or aromatic vinylsulfonic acid or the like, and sulfonic acid base-containing monomer such as alkali metal salt, ammonium salt, amine salt of these sulfonic acid group-containing monomer and equivalents; (d) hydroxyl group-containing monomer, which is represented by ethylenic unsaturated ether of polyols, (meth)acrylate ester of polyhydric alcohol or the like; (e) amino group-containing monomer such as dimethylaminoethyl(meth)acrylate-2-vinylpiridine or the like; (f) quaternary ammonium base-containing monomer; (g) alkyl ester of ethylenic unsaturated carboxylic acid; (h) nitrile group-containing monomer such as (meth)acrylonitrile or the like; (i) styrene; (j) ester of ethylenic unsaturated alcohol such as vinyl acetate, (meth)allyl acetate or the like; (k) mono(meth)acrylates of alkylene oxide-addition polymer of active hydrogen-containing compound; (1) ester group-containing bifunctional monomer, which is represented by diester of polybasic acid and unsaturated alcohol; (m) bifunctional monomer which is a diester of (meth)acrylic acid and alkylene oxide-addition polymer of active hydrogen-containing compound; (n) bisacrylamide such as N,N-methylenebisacrylamide or the like; (o) bifunctional monomer such as divinylbenzene, divinylethylene glycol, divinylsulfone, divinyl ether, divinylketone or the like; (p) ester group-containing polyfunctional monomer, which is represented by polyester of polybasic acid and unsaturated alcohol; (q) polyfunctional monomer which is a polyester of (meth)acrylic acid and alkylene oxide-addition polymer of active hydrogen-containing compound; (r) polyfunctional unsaturated monomer such as trivinylbenzene; and equivalents.

These electron rays-curable prepolymer or monomer can be used as required in combination of at least two of them. Further, it is possible to use prepolymer and monomer conjointly. Although the amount of the binder to be used is not specifically limited, it is generally adjusted in a range of 10 to 90% by weight, preferably 20 to 70% by weight, based on the total sold weight of the recording layer.

Furthermore, in order to impart a suitable flexibility to the thermofixable photosensitive recording layer, plasticizers can be added. Examples of the plasticizer include phthalates such as diethyl phthalate, dibutyl phthalate, diheptyl phthalate, dioctyl phthalate, and equivalents; aliphatic esters such as dioctyl adipate, dibutyl diglycol adipate, and equivalents; phosphates such as triphenyl phosphine, and equivalents; sulfonamides such as toluenesulfonamide, and equivalents; polyvalent alcohols such as ethylene glycol, glycerin, pentaerythritol, polyethylene glycol, and equivalents further, the plasticizer also serve as an improver for color forming and fixing properties by increasing a fluidity of the respective components of the material. Although the amount of the plasticizer to be used is not specifically limited, it is generally adjusted in a range of 5 to 50% by weight of the binder.

Further, for the purpose of preventing influences of ultraviolet rays under circumstances of using a photosensitive recording material, ultraviolet rays absorbers can be added to the recording layer. Examples of the ultraviolet rays absorber include salicylate compound, benzotriazole compound, benzophenone compound, cyanoacrylate compound, hexamethyl phosphoric triamide, aromatic ester compound, organophosphorous-sulfur compound, [2,2'-thiobis(4-tert-octylphenolate)]-n-butylamine-nickel compound and the like. Although the amount of the ultraviolet rays absorber to be used is not specifically limited, it is generally suitable to use in a range of 0.2 to 10% by weight of the binder.

As stated above, in the present thermofixable photosensitive recording material, the recording layer must be an amorphous state in which the three components of the specific pyrazolone derivative, a hydroquinone derivative, an acidic substance and, optionally usable components described above such as a binder are dissolved mutually therein.

The method of forming the recording layer in such an amorphous state is not particularly limited. For example, case of forming a recording layer in an amorphous state using the three components of the specific pyrazolone derivative, a hydroquinone derivative and an acidic substance, the recording layer can be obtained by dissolving and mixing these three components in a suitable organic solvent under a safety lamp cutting ultraviolet rays, or further emulsifying them in water, applying the resulting coating composition on various substrates such as resin film, synthetic paper, and equivalents, followed by drying. By this way, it is possible to obtain a photosensitive recording material having a recording layer in an amorphous state in which the above three components are dissolved mutually therein.

Examples of the organic solvent include acrylonitrile; alcohols such as methanol, ethanol, n-propanol, isopropanol, n-butanol, cyclohexanol, ethylene glycol, polyethylene glycol, methyl cellosolve, ethyl cellosolve, and equivalents; ketones such as acetone, methyl ethyl ketone, methyl isobutyl ketone, 3-pentanone, and equivalents; aromatic hydrocarbons such as toluene, xylene, o-dichlorobenzene, and equivalents; amides such as formamide, dimethylformamide, hexaneamide, and equivalents; esters such as ethyl acetate, ethyl benzoate, and equivalents; tetrahydrofuran, acetonitrile, dimethyl sulfoxide, dioxane, and equivalents.

Further, in case of using a polymer compound soluble in an organic solvent as a binder, the photosensitive recording material can be obtained by dissolving and mixing the polymer compound in an organic solvent solution of the above three components, or further emulsifying them in water, applying the resulting coating composition on a substrate, followed by drying.

The present thermofixable photosensitive recording material becomes inactive to ultraviolet rays when dried at too high temperature, therefore, the coating composition is dried preferably less than 100° C.

Alternately, in case of using an electron rays-curable prepolymer or monomer as a binder, the prepolymer or monomer functions as a solvent. Thus, the recording layer can be obtained by dissolving and mixing these three components of the pyrazolone derivative, a hydroquinone derivative and an acidic substance in the prepolymer or monomer, applying the resulting coating composition on a substrate, followed by irradiation of an electron rays. Thus, it is possible to obtain a recording layer in an amorphous state in which the above four components are dissolved mutually therein. Also in case of using an electron rays-curable prepolymer or monomer as a binder, it is possible to emulsify the solution dissolved the three components therein in water to form a coating composition for the recording layer. In this case, the recording layer is obtained by applying the coating composition on a substrate, followed by drying and irradiation of an electron rays to cure the coating film. Although the electron rays-curable prepolymer or monomer functions also as a solvent, the above organic solvent can be used conjointly as required.

When the electron rays-curable prepolymer or monomer is used, the dose of electron rays irradiated is in the range of 1.0 to 15 Mrad, more preferably 0.5 to 10 Mrad. With less than 1.0 Mrad, the resin component can not be cured sufficiently. Excess irradiation of more than 15 Mrad, the photosensitive recording material is apt to be deteriorated. As an irradiation method of electron rays, for example, scanning system, curtain-beam system, broad-beam system and the like are adopted. When irradiation, an acceleration voltage is preferably in the range of 100 to 300 KV.

Further, the substrate may be those which do not affect color forming and fixing properties, and various transparent and opaque substrates can be used. Examples thereof include polyester films such as polyethylene terephthalate, polybutylene terephthalate, and equivalents; cellulose derivative films such as cellulose triacetate, and equivalents; polyolefin films such as polypropylene, polyethylene, and equivalents; other synthetic polymer films such as polystyrene film, polyimide film, polyvinyl chloride film, polyvinylidene chloride film, polyacryl film, polycarbonate film, and equivalents; general papers such as wood free paper, clay-coated paper, and equivalents; laminate paper coated with synthetic polymer compound, synthetic paper, and equivalents.

An over coat layer can be provided on the thermofixable photosensitive recording layer for the purpose of protecting the layer, and ultraviolet rays absorbers can also be contained in the over coat layer.

As a forming method of an image on the thermofixable photosensitive recording layer of the present invention, for example, there can be used a method comprising placing a negative manuscript over a photosensitive layer (recording layer), exposing the whole area to a suitable ultraviolet rays source, e.g. ultraviolet rays from mercury lamp, and equivalents and heating the whole area of the thermofixable photosensitive recording layer by means of a suitable means, e.g. passing through a hot roller, to obtain a positive image, method comprising recording an image on a thermofixable photosensitive layer by means of a suitable heat source such as thermal head, etc. and exposing the whole area to a suitable ultraviolet rays source to obtain a negative image of which recorded area is colorless, and the like. In forming record images of the present thermofixable photosensitive recording material, the wave length of the ultraviolet rays is generally in the range of 200 to 400 nm, preferably 250 to 400 nm, both in the case of positive images and negative images. Further, the temperature for thermal fixing or thermal recording is generally in the range of 110° to 150° C., preferably 120° to 130°.

When using the photosensitive recording material of the present invention, a colored image having a good quality can be easily formed as described above under sanitary working environment and, therefore, it can be applied to various image forming materials. For example, it can be used for various copying materials, printing proof materials and the like. Furthermore, it can also be applied to the field to which an exposure visibility is required, e.g. various printing materials represented by PS plate, and equivalents. Among them, the resulting recording material is useful as a sheet for overhead projector when using a transparent sheet as the substrate.

The present invention will be described in greater detail with reference to the following examples, to which the invention is not limited. The parts and percentages in the examples are all by weight unless otherwise specified.

EXAMPLE 1

A coating composition prepared by dissolving one part of 1,3-diphenyl-4-(4-N,N-diethylaminophenylamino)-4-acetylamino-5-pyrazolone, 2 parts of 2-tert-butylhydroquinone, 2 parts of zinc 3,5-di-(α-methylbenzyl)salicylate and 10 parts of polyvinyl butyral [Eslek BLS (trade name), manufactured by Sekisui Kagaku Co, Ltd.] in 50 parts of methyl ethyl ketone was applied on a transparent polyethylene terephthalate film having a thickness of 75 μm and subjected to corona discharge treatment in an amount of 5.0 $g/m^2$ calculated as dry weight under a safety lamp (UV-cut light), using a wire bar, followed by drying at room temperature to obtain a thermofixable photosensitive recording material.

EXAMPLES 2 to 7

Six kinds of thermofixable photosensitive recording materials were prepared in the same manner as in Example 1 except that the following compounds were used in place of 1,3-diphenyl-4-( 4-N,N-diethylaminophenylamino)-4-acetylamino-5-pyrazolone.

EXAMPLE 2

1-phenyl-3-(1-naphthyl)-4-(4-N,N-diethylaminophenylamino)- 4-acetylamino-5-Pyrazolone

EXAMPLE 3

1,3-diphenyl-4-[4-N-ethyl-N-(2-hydroxyethyl)aminophenylamino]-4-acetylamino-5-pyrazolone

EXAMPLE 4

1-(2,4,6-trichlorophenyl)-3-phenyl-4-(4-N,N-diethylaminophenylamino)- 4-acetylamino-5-pyrazolone

EXAMPLE 5

1,3-diphenyl-4-(4-N,N-diethylamino-2-methylphenylamino)- 4-acetylamino-5-pyrazolone

EXAMPLE 6

1,3-diphenyl-4-(4-N,N-diethylamino-2-methoxyphenylamino)- 4-acetylamino-5-pyrazolone

EXAMPLE 7

1-phenyl-3-p-tolyl-4-(4-N,N-diethylaminophenylamino)-4-acetylamino-5-pyrazolone

EXAMPLE 8

A thermofixable photosensitive recording material was prepared in the same manner as in Example 1 except that 1-phenyl-3-benzoylamino- 4-(4-N,N-diethylaminophenylamino)-4-acetylamino-5-pyrazolone was used in place of 1,3-diphenyl-4-(4-N,N-diethylaminophenylamino)-4-acetylamino-5-pyrazolone.

EXAMPLES 9 to 11

Three kinds of thermofixable photosensitive recording materials were prepared in the same manner as in Example 1 except that the following compounds were used in place of 2-tert-butylhydroquinone.

EXAMPLE 9

2,5-di-tert-pentylhydroquinone

EXAMPLE 10

2-α-methylbenzylhydroquinone

EXAMPLE 11

2,5-bis(α-methylbenzyl)hydroquinone

EXAMPLE 12

A thermofixable photosensitive recording material was prepared in the same manner as in Example 1 except that 4-tert-butylbenzoic acid was used in place of zinc 3,5-di-(α-methylbenzyl)salicylate.

EXAMPLE 13

A thermofixable photosensitive recording material was prepared in the same manner as in Example 1 except that α-naphthoic acid was used in place of zinc 3,5-di-(α-methylbenzyl)salicylate.

EXAMPLE 14

A coating composition prepared by dissolving one part of 1,3-diphenyl-4-(4-N,N-diethylaminophenylamino)-4-acetylamino-5-pyrazolone, 2 parts of 2-tert-butylhydroquinone and 2 parts of zinc 3,5-di-(α-methylbenzyl)salicylate in 10 parts of a mixture of electron rays-curable prepolymer and monomer [COADIC EXP3901A (trade name), manufactured by Dainippon Ink and Chemicals Inc.] was applied on a transparent polyethylene terephthalate film having a thickness of 75 μm and subjected to corona discharge treatment in an amount of 5.0 g/m$^2$ calculated as dry weight under a safety lamp (UV-cut light), followed by curing with an electron curtain type irradiation device [CB-150, Energy Sciences INC.] at an irradiation dose of 3 Mrad to obtain a thermofixable photosensitive recording material.

Comparative Example 1

A coating composition prepared by dissolving one part of 4,4'-bis(dimethylamino)-3"-methyl-4"-ethoxytriphenylmethane, 2 parts of α,α,α-tribromoacetophenone, and 10 parts of polyvinyl butyral [Eslek BLS (trade name), manufactured by Sekisui Kagaku Co, Ltd.] in 50 parts of methyl ethyl ketone was applied on a transparent polyethylene terephthalate film having a thickness of 75 μm and subjected to corona discharge treatment in an amount of 5.0 g/m$^2$ calculated as dry weight under a safety lamp (UV-cut light), using a wire bar, followed by drying at room temperature to obtain a thermofixable photosensitive recording material.

Comparative Example 2

A thermofixable photosensitive recording material was prepared in the same manner as in Example 1 except that 2-tert-butylhydroquinone and zinc 3,5-di-(α-methylbenzyl-)salicylate were not used in Example 1.

Comparative Example 3

A thermofixable photosensitive recording material was prepared in the same manner as in Example 1 except that 2-tert-butylhydroquinone was not used in Example 1.

Comparative Example 4

A thermofixable photosensitive recording material was prepared in the same manner as in Example 1 except that zinc 3,5-di-(α-methylbenzyl)salicylate was not used in Example 1.

Comparative Example 5

① Preparation of Composition A

A composition comprising 10 parts of 1,3-diphenyl-4-(4-N,N-diethylaminophenylamino)-4-acetylamino-5-pyrazolone, 10 parts of 5% aqueous solution of methyl cellulose and 20 parts of water was pulverized to a mean particle size of 1.5 μm by a sand mill.

② Preparation of Composition B

A composition comprising 20 parts of 2-tert-butylhydroquinone, 20 parts of 5% aqueous solution of methyl cellulose and 40 parts of water was pulverized to a mean particle size of 1.5 μm by a sand mill.

③ Preparation of Composition C

A composition comprising 20 parts of zinc 3,5-di-(α-methylbenzyl)salicylate, 20 parts of 5% aqueous solution of methyl cellulose and 40 parts of water was pulverized to a mean particle size of 1.5 μm by a sand mill.

④ formation of recording layer

A coating composition was prepared, under a safety lamp (UV-cut light), by mixing together 40 parts of Composition A, 80 parts of Composition B, 80 parts of Composition C and 500 parts of 20% aqueous solution of oxidized starch. The composition obtained was applied on a synthetic paper [Yupo FPG (trade name), manufactured by Oji Yuka Gohseishi Co, Ltd.] having a thickness of 80 μm in an amount of 5.0 g/m$^2$ calculated as dry weight using a wire bar, followed by drying to obtain a thermofixable photosensitive recording material.

The nineteen kinds of thermofixable photosensitive recording materials thus obtained was evaluated according to the following method. The results are shown in Table 1.

[photosensitivity and thermal fixing property]

A negative film manuscript was placed in contact with the surface of a photosensitive layer of a thermofixable photosensitive recording material and, after exposing to a 2 KW high-pressure mercury lamp (main wave length: 365 nm, strength: 8 mW/cm$^2$) for one minute, the negative film manuscript was removed. Then, it was placed in contact with a hot plate having a surface temperature of 120° C. for 2 seconds to complete fixing. The density of the exposed and non-exposed areas were measured by a Macbeth transmission densitometer (TD-904 Model, manufactured by Macbeth Corp.). Since the photosensitive layer (recording layer) is opaque in the photosensitive recording material of Comparative Example 5, the density of the exposed and non-exposed areas were measured by a Macbeth reflection densitometer (RD-914 Model, manufactured by Macbeth Corp.). The greater the value of the exposed area, the better the color forming property. The smaller the value of the non-exposed area, the better the transparency.

[Preservability of images recorded]

Regarding a thermofixable photosensitive recording material in which an image has been formed according to the same manner as that described above, the density of the exposed and non-exposed areas were measured by a Macbeth transmission densitometer (TD-904 Model) or a Macbeth reflection densitometer (RD-914 Model) after standing for 3 months under room light. The greater the value of the exposed area, the better the preservability of images recorded. The smaller the value of the non-exposed area, the better the thermal fixing property.

[Storage stability]

Regarding a thermofixable photosensitive recording material before exposure, the density of each photosensitive layer was measured by a Macbeth densitometer (TD-904 Model or RD-914 Model) after standing for 6 months in a dark place. The smaller the value, the better the storage stability.

TABLE 1

| | Color tone of | Density of images recorded | | Preservability of images recorded | | |
|---|---|---|---|---|---|---|
| | images recorded | exposed area | non-exposed area | exposed area | non-exposed area | Storage stability |
| Ex. 1 | bluish purple | 1.25 | 0.05 | 1.35 | 0.06 | 0.05 |
| Ex. 2 | bluish purple | 1.23 | 0.05 | 1.33 | 0.06 | 0.05 |
| Ex. 3 | bluish purple | 1.25 | 0.05 | 1.32 | 0.06 | 0.05 |
| Ex. 4 | bluish purple | 1.24 | 0.05 | 1.32 | 0.06 | 0.05 |
| Ex. 5 | bluish purple | 1.22 | 0.05 | 1.30 | 0.06 | 0.05 |
| Ex. 6 | bluish purple | 1.24 | 0.05 | 1.31 | 0.06 | 0.05 |
| Ex. 7 | bluish purple | 1.25 | 0.05 | 1.36 | 0.06 | 0.05 |
| Ex. 8 | bluish purple | 1.05 | 0.05 | 1.25 | 0.08 | 0.05 |
| Ex. 9 | bluish purple | 1.16 | 0.05 | 1.33 | 0.07 | 0.05 |
| Ex. 10 | bluish purple | 1.25 | 0.05 | 1.35 | 0.06 | 0.05 |
| Ex. 11 | bluish purple | 1.13 | 0.05 | 1.31 | 0.07 | 0.05 |
| Ex. 12 | purple | 1.23 | 0.05 | 1.35 | 0.06 | 0.05 |
| Ex. 13 | purple | 1.22 | 0.05 | 1.32 | 0.06 | 0.05 |
| Ex. 14 | bluish purple | 1.21 | 0.07 | 1.24 | 0.08 | 0.07 |
| Com. Ex. 1 | bluish green | 0.78 | 0.11 | 1.10 | 0.64 | 0.28 |
| Com. Ex. 2 | — | 0.07 | 0.05 | 0.09 | 0.07 | 0.05 |
| Com. Ex. 3 | — | 0.06 | 0.05 | 0.45 | 0.40 | 0.05 |
| Com. Ex. 4 | — | 0.06 | 0.05 | 0.20 | 0.11 | 0.05 |
| Com. Ex. 5 | — | 0.07 | 0.07 | 0.23 | 0.23 | 0.05 |

As apparent from the results of Table 1, the thermofixable photosensitive recording material of the present invention is excellent in color forming property, thermal fixing property, stability of images and storage stability.

What is claimed is:

1. A thermofixable photosensitive recording material comprising a substrate and a recording layer formed thereon in which at least a pyrazolone derivative represented by the formula (1), a hydroquinone derivative and an acidic substance are dissolved mutually therein

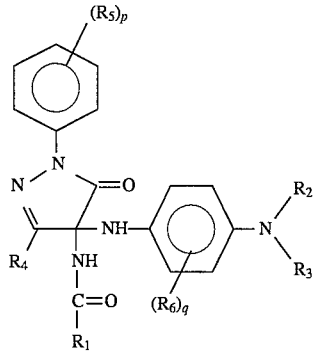

(1)

wherein, in the formula (1), $R_1$ is (a) alkyl, (b) alkoxyalkyl, (c) aryl or (d) aryl having a substituent selected from the group consisting of alkyl, alkoxyl and a halogen atom, $R_2$ and $R_3$ are each (a) alkyl, (b) alkyl having a substituent selected from the group consisting of aryl, alkoxyl, hydroxyl and alkylsulfonylamino, (c) aryl or (d) aryl having a substituent selected from the group consisting of alkyl, alkoxyl and a halogen atom, $R_4$ is (a) alkyl, (b) alkyl having a substituent selected from the group consisting of aryl, alkoxyl, aryloxy, acylamino, N-substituted carbamoyl and N-substituted sulfamoyl, (c) aryl, (d) aryl having a substituent selected from the group consisting of alkyl, alkoxyl, aryloxy, a halogen atom, arylalkyl, arylalkoxyl, aryloxyalkoxyl, arylsulfonylalkoxyl, acylamino, alkylsulfonylamino, arylsulfonylalmino, N-substituted carbamoyl and N-substituted sulfamoyl, (e) amino or (f) amino having a substituent selected from the group consisting of alkyl, aryl, alkylcarbonyl, arylcarbonyl, alkylsulfonyl and arylsulfonyl, $R_5$ and $R_6$ are each (a) alkyl, (b) alkoxyl or a (c) halogen atom, wherein the alkyl group substituents are unsubstituted or have a substituent selected from the group consisting of aryl, alkoxyl, aryloxy, acylamino, N-substituted carbamoyl and N-substituted sulfamoyl, wherein the aryl group substituents are unsubstituted or have a substituent selected from the group consisting of alkyl, alkoxyl, aryloxy, a halogen atom arylalkyl, arylalkoxyl, aryloxyalkoxyl, arylsulfonylalkoxyl, imido, acylamino, alkylsulfonylamino, arylsulfonylamino, N-substituted carbamoyl and N-substituted sulfamoyl, and where p is 0 or an integer of 1 to 5, and q is 0 or an integer of 1 to 4.

2. A thermofixable photosensitive recording material as defined in claim 1 wherein the recording layer further contains a binder which is mutually dissolved therein.

3. A thermofixable photosensitive recording material as defined in claim 1 wherein an aromatic carboxylic acid derivative or polyvalent metal salt thereof is used as the acidic substance.

4. A thermofixable photosensitive recording material as defined in claim 1 wherein a compound of the following formula (2) is used as the hydroquinone derivative

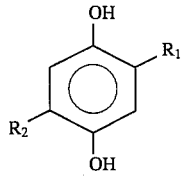

(2)

wherein, in the formula (2), $R_1$ is $C_1$~$C_{22}$ alkyl, $C_5$~$C_6$ cycloalkyl or $C_7$~$C_{22}$ aralkyl, $R_2$ is hydrogen atom, $C_1$~$C_{22}$ alkyl, $C_5$~$C_6$ cycloalkyl or $C_7$~$C_{22}$ aralkyl.

5. A thermofixable photosensitive recording material as defined in claim 1 wherein, in the formula (1), $R_1$ is (a) $C_1$–$C_4$ alkyl or (b) phenyl, $R_2$ and $R_3$ are each (a) $C_1$–$C_4$ alkyl, (b) $C_1$–$C_4$ alkyl having $C_1$–$C_4$ alkoxyl, hydroxyl or $C_1$–$C_4$ alkylsulfonylamino as a substituent, $R_4$ is (a) aroylamino or (b) aroylamino having a substituent selected from the group consisting of alkyl, alkoxyl, aryloxy, halogen atom, arylalkyl, arylalkoxyl, aryloxyalkoxyl, arylsulfonylalkoxyl, imido, acylamino, alkylsulfonylamino, arylsulfonylamino, N-substituted carbamoyl and N-substituted sulfamoyl, (c) aryl or (d) aryl having a substituent selected from the group consisting of $C_1$–$C_4$ alkyl, $C_1$–$C_4$ alkoxyl and a halogen atom, $R_5$ is halogen atom, $R_6$ is (a) $C_1$–$C_4$ alkyl or (b) $C_1$–$C_4$ alkoxyl, p is 0 or an integer of 1 to 3, and q is 0 or an integer of 1 to 2.

6. A thermofixable photosensitive recording material as defined in claim 5 wherein, in the formula (1), $R_1$ is $C_1$~$C_4$ alkyl, $R_2$ and $R_3$ are each $C_1$~$C_4$ alkyl, $C_1$~$C_4$ alkyl having $C_1$~$C_4$ alkoxyl, hydroxyl or $C_1$~$C_4$ alkylsulfonylamino as a substituent, $R_4$ is phenyl, phenyl having $C_1$~$C_4$ alkyl, $C_1$~$C_4$ alkoxyl or halogen atom, naphthyl or naphthyl having $C_1$~$C_4$ alkyl, $C_1$~$C_4$ alkoxyl or halogen atom, $R_5$ is halogen atom, $R_6$ is $C_1$~$C_4$ alkyl or $C_1$~$C_4$ alkoxyl, p is 0 or an integer of 1to 3, and q is 0 or an integer of 1 to 2.

7. A thermofixable photosensitive recording material as defined in claim 4 wherein, in the formula (2), $R_1$ is $C_1$~$C_8$ alkyl, $C_5$~$C_6$ cycloalkyl or $C_7$~$C_{10}$ aralkyl, $R_2$ is hydrogen atom, $C_1$~$C_8$ alkyl, $C_5$~$C_6$ cycloalkyl or $C_7$~$C_{10}$ aralkyl.

8. A thermofixable photosensitive recording material as defined in claim 2 wherein the binder is a polymer compound which is soluble in an organic solvent.

9. A thermofixable photosensitive recording material as defined in claim 2 wherein the binder is an electron rays-curable prepolymer and/or monomer.

10. A process for preparing a thermofixable photosensitive recording material comprising dissolving a pyrazolone derivative represented by the formula (1), a hydroquinone derivative, an acidic substance and optionally usable binder in an organic solvent to form a solution, or dissolving a pyrazolone derivative represented by the formula (1), a hydroquinone derivative and an acidic substance in an electron rays-curable prepolymer and/or monomer to form a solution, further dispersing the solution in water as required, applying the resulting coating composition for a recording layer on a substrate, and drying or irradiating electron rays to cure the recording layer

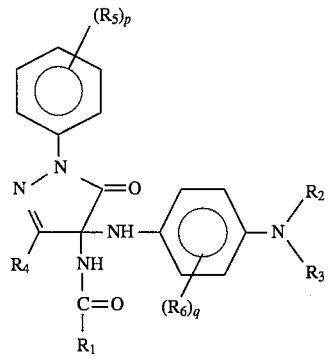

(1)

wherein, in the formula (1), $R_1$ is (a) alkyl, (b) alkoxyalkyl, (c) aryl or (d) aryl having a substituent selected from the group consisting of alkyl, alkoxyl and a halogen atom, $R_2$ and $R_3$ are each (a) alkyl, (b) alkyl having a substituent selected from the group consisting of aryl, alkoxyl, hydroxyl and alkylsulfonylamino, (c) aryl or (d) aryl having a substituent selected from the group consisting of alkyl, akloxyl and a halogen atom, $R_4$ is (a) alkyl, (b) alkyl having a substituent selected from the group consisting of aryl, alkoxyl, aryloxy, acylamino, N-substituted carbamoyl and N-substituted sulfamoyl, (c) aryl, (d) aryl having a substituent selected from the group consisting of alkyl, alkoxyl, aryloxy, a halogen atom, arylalkyl, arylalkoxyl, aryloxyalkoxyl, arylsulfonylalkoxyl, acylamino, alkylsulfonylamino, arylsulfonylalmino, N-substituted carbamoyl and N-substituted sulfamoyl (e) amino or (f) amino having a substituent selected from the group consisting of alkyl, aryl, alkyl carbonyl, arylcarbonyl, alkylsulfonyl and arylsulfonyl, $R_5$ and $R_6$ are each (a) alkyl, (b) alkoxyl or (c) a halogen atom, wherein the alkyl group substituents are unsubstituted or have a substituent selected from the group consisting of aryl, alkoxyl, aryloxy, acylamino, N-substituted carbamoyl and N-substituted sulfamoyl, wherein the aryl group substituents are unsubstituted or have a substituent selected from the group consisting of alkyl, alkoxyl, aryloxy, a halogen atom, arylalkyl, arylalkoxyl, aryloxyalkoxyl, arylsulfonylalkoxyl, imido, acylamino, alkylsulfonylamino, arylsulfonylamino, N-substituted carbamoyl and N-substituted sulfamoyl, and wherein p is 0 or an integer of 1 to 5, and q is 0 or an integer of 1 to 4.

11. A process for preparing a thermofixable photosensitive recording material as defined in claim 10 wherein an aromatic carboxylic acid derivative or polyvalent metal salt thereof is used as the acidic substance.

12. A process for preparing a thermofixable photosensitive recording material as defined in claim 10 wherein a compound of the following formula (2) is used as the hydroquinone derivative

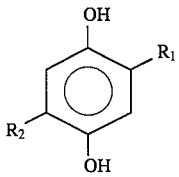

(2)

wherein, in the formula (2), $R_1$ is $C_1$~$C_{22}$ alkyl, $C_5$~$C_6$ cycloalkyl or $C_7$~$C_{22}$ aralkyl, $R_2$ is hydrogen atom, $C_1$~$C_{22}$ alkyl, $C_5$~$C_6$ cycloalkyl or $C_7$~$C_{22}$ aralkyl.

13. A process for preparing a thermofixable photosensitive recording material as defined in claim 10 wherein, in the formula (1), $R_1$ is (a) $C_1$–$C_4$ alkyl or (b) phenyl, $R_2$ and $R_3$ are each (a) $C_1$–$C_4$ alkyl, (b) $C_1$–$C_4$ alkyl having $C_1$–$C_4$ alkoxyl, hydroxyl or $C_1$–$C_4$ alkylsulfonylamino as a substituent, $R_4$ is (a) aroylamino or (b) aroylamino having a substituent selected from the group consisting of alkyl, alkoxyl, aryloxy, halogen atom, arylalkyl, arylalkoxyl, aryloxyalkoxyl, arylsulfonylalkoxyl, imido, acylamino, alkylsulfonylamino, arylsulfonylamino, N-substituted carbamoyl, and N-substituted sulfamoyl, (c) aryl or (d) aryl having a substituent selected from the group consisting of $C_1$–$C_4$ alkyl, $C_1$–$C_4$ alkoxyl and a halogen atom, $R_5$ is halogen atom, $R_6$ is (a) $C_1$–$C_4$ alkyl or (b) $C_1$–$C_4$ alkoxyl, p is 0 or an integer of 1 to 3, and q is 0 or an integer of 1 to 2.

14. A process for preparing a thermofixable photosensitive recording material as defined in claim 13 wherein, in the formula (1), $R_1$ is $C_1$~$C_4$ alkyl, $R_2$ and $R_3$ are each $C_1$~$C_4$ alkyl, $C_1$~$C_4$ alkyl having $C_1$~$C_4$ alkoxyl, hydroxyl or $C_1$~$C_4$ alkylsulfonylamino as a substituent, $R_4$ is phenyl, phenyl having $C_1$~$C_4$ alkyl, $C_1$~$C_4$ alkoxyl or halogen atom, naphthyl or naphthyl having $C_1$~$C_4$ alkyl, $C_1$~$C_4$ alkoxyl or halogen atom, $R_5$ is halogen atom, $R_6$ is $C_1$~$C_4$ alkyl or $C_1$~$C_4$ alkoxyl, p is 0 or an integer of 1 to 3, and q is 0 or an integer of 1 to 2.

15. A process for preparing a thermofixable photosensitive recording material as defined in claim 12 wherein, in the formula (2), $R_1$ is $C_1$~$C_8$ alkyl, $C_5$~$C_6$ cycloalkyl or $C_7$~$C_{10}$ aralkyl, $R_2$ is hydrogen atom, $C_1$~$C_8$ alkyl, $C_5$~$C_6$ cycloalkyl or $C_7$~$C_{10}$ aralkyl.

* * * * *